US010870516B1

(12) United States Patent
Worley

(10) Patent No.: US 10,870,516 B1
(45) Date of Patent: Dec. 22, 2020

(54) POURING ASSEMBLY FOR A CONTAINER

(71) Applicant: Gregory Harrison Worley, St. Louis, MO (US)

(72) Inventor: Gregory Harrison Worley, St. Louis, MO (US)

( * ) Notice: Subject to any disclaimer, the term of this patent is extended or adjusted under 35 U.S.C. 154(b) by 0 days.

(21) Appl. No.: 16/447,316

(22) Filed: Jun. 20, 2019

Related U.S. Application Data

(60) Provisional application No. 62/688,542, filed on Jun. 22, 2018.

(51) Int. Cl.
*B65D 25/44* (2006.01)
*B65D 25/48* (2006.01)
*B44D 3/12* (2006.01)

(52) U.S. Cl.
CPC ..... *B65D 25/44* (2013.01); *B65D 25/48* (2013.01); *B44D 3/12* (2013.01)

(58) Field of Classification Search
CPC ..... B65D 25/44; B65D 25/48; B44D 3/12
USPC ..... 222/539, 538, 570; 220/695–702
See application file for complete search history.

(56) References Cited

U.S. PATENT DOCUMENTS 1,738,077 A 12/1929 Petersen
1,768,098 A 6/1930 Aulbach
1,947,915 A 2/1934 Marschall
2,498,318 A 2/1950 Violette
2,545,178 A * 3/1951 Gar ..... B65D 47/061 222/525
2,559,202 A 7/1951 Sherry
2,767,891 A 10/1956 Beadles
2,771,208 A 11/1956 Joseph
3,172,573 A * 3/1965 Parish, Jr. ..... B65D 47/061 222/153.06
3,235,146 A * 2/1966 Parish, Jr. ..... B65D 47/061 222/478
3,300,104 A 1/1967 Burt
3,831,824 A 8/1974 Coppersmith
3,915,360 A 10/1975 Leger et al.
3,938,714 A 2/1976 Coppersmith
4,311,259 A 1/1982 Babiol
(Continued)

OTHER PUBLICATIONS

Shur-Line Pour and Store Gallon Paint Can Lid [online]. Shur-Line. Retrieved from the Internet on Apr. 18, 2019 <URL:https://www.homedepot.com/p/Shur-Line-Pour-and-Store-Gallon-Paint-Can-Lid-2007061/202903561>.

(Continued)

*Primary Examiner* — Lien M Ngo
(74) *Attorney, Agent, or Firm* — Creativenture Law, LLC; Kevin C. Staed; Dennis J M Donahue, III

(57) ABSTRACT

A spout for a paint container having a retracted position with the spout resting within the volume of the container and an extended position with a portion of the spout extending through the top opening of the can. When retracted, the can is sealable with a friction fit lid in the rim channel, as is commonly used with paint cans, or the assembly may include a collar mountable within a rim channel that accommodates the traditional paint can lid. Regardless of the embodiment, the spout is held within the can proximate to the rim and can quickly move between the extended and retracted positions with a flange on the lower portion of the spout sealing against the annular collar in the extended position and tabs on the top portion of the spout holding the spout near the rim when retracted.

20 Claims, 11 Drawing Sheets

(56) References Cited

U.S. PATENT DOCUMENTS

| | | | | | |
|---|---|---|---|---|---|
| 4,736,874 | A | | 4/1988 | Durant | |
| 5,031,804 | A | * | 7/1991 | Conrad | B65D 25/48 222/566 |
| 5,392,969 | A | | 2/1995 | Usery | |
| 5,967,363 | A | * | 10/1999 | Allen | B44D 3/128 220/701 |
| 9,056,699 | B2 | * | 6/2015 | Crosby | B65D 47/063 |
| 10,112,746 | B2 | * | 10/2018 | Crosby | B65D 47/0885 |

OTHER PUBLICATIONS

SnapNSave Painting System [online]. SnapNSave. Retrieved from the Internet on Apr. 18, 2019 <URL:https://www.kickstarter.com/projects/1202938191/snapnsave-an-amazing-painting-system>.

* cited by examiner

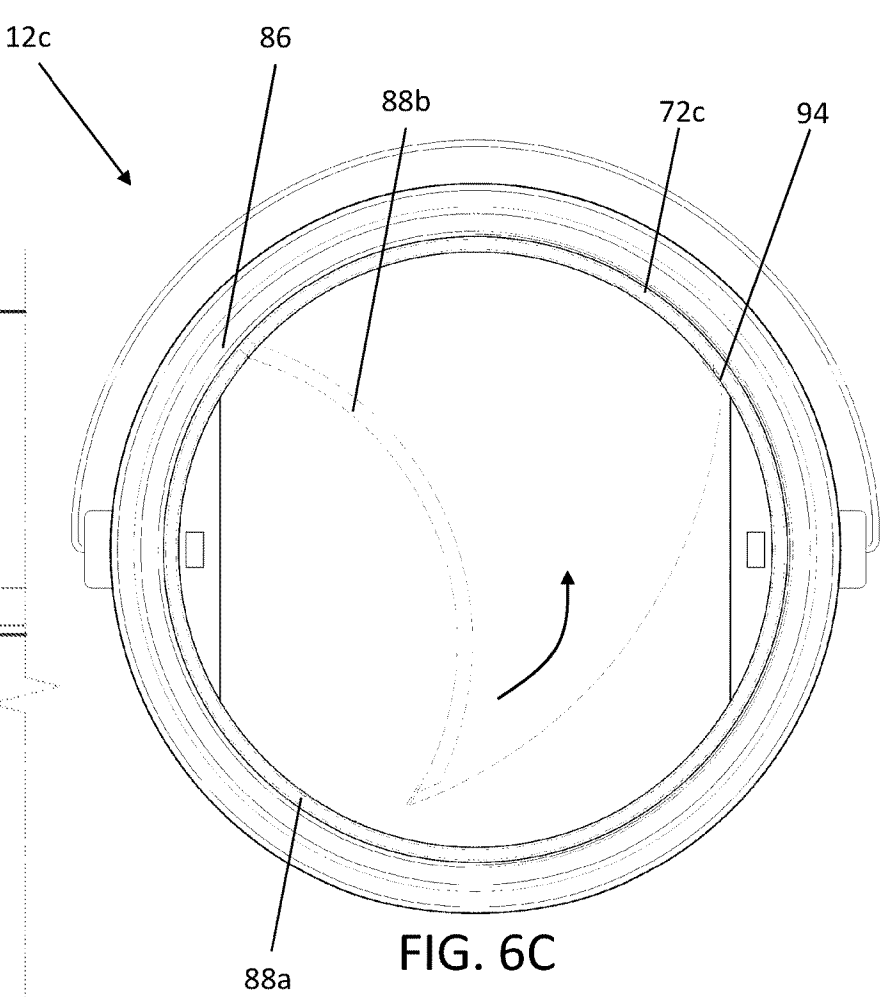
FIG. 6C
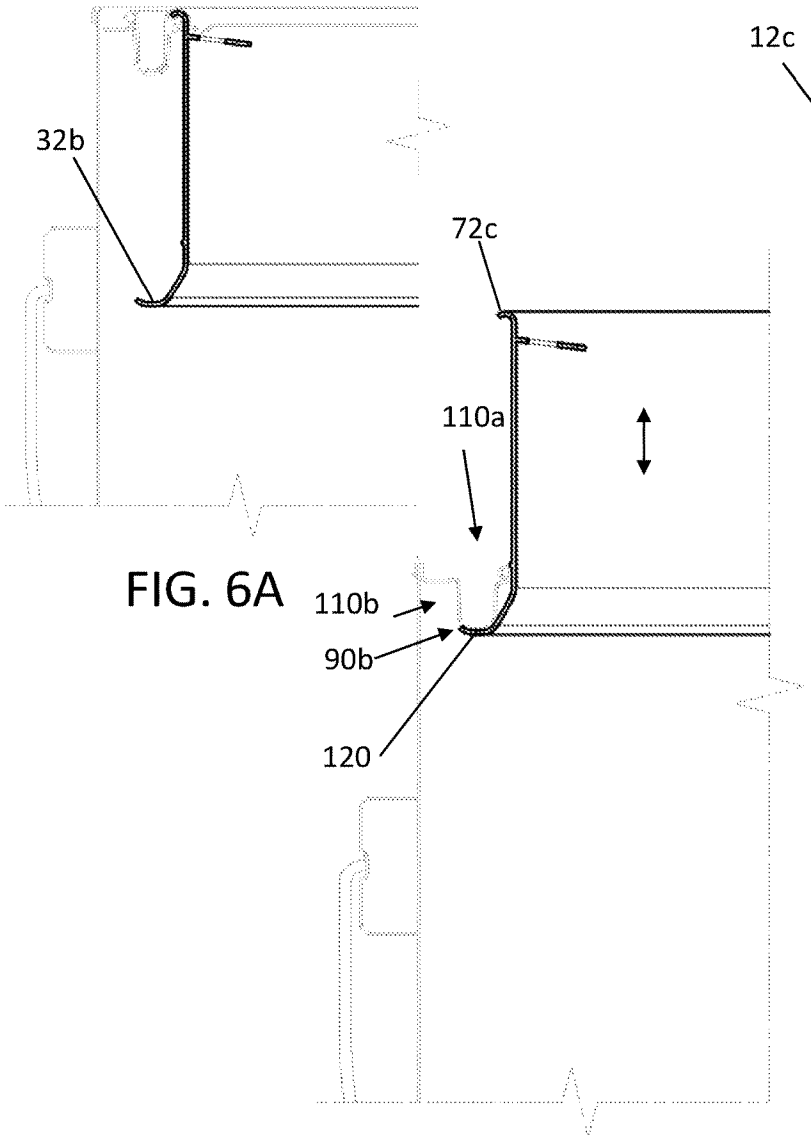
FIG. 6B
FIG. 6A

POURING ASSEMBLY FOR A CONTAINER

CROSS-REFERENCE TO RELATED APPLICATIONS

This application claims priority from U.S. Provisional Patent Application No. 62/688,542 filed on Jun. 22, 2018.

STATEMENT REGARDING FEDERALLY SPONSORED RESEARCH

Not Applicable.

APPENDIX

Not Applicable.

BACKGROUND OF THE INVENTION

Field of the Invention

The present invention relates to pouring spouts, and more particularly to retractable spouts for paint cans.

Related Art

It is well known to persons having an ordinary skill in the art that pouring paint from containers can be a messy operation. The contents invariably drip or run down the outside of the can during pouring and subsequently must be wiped with a rag or paint brush before running down the can and onto the floor. Paint is also necessarily mixed prior to use and most painters use paint mixing sticks to accomplish this task before pouring the paint into a small hand held paint container, roller tray or paint sprayer. Accordingly, paint is liable to spill during the mixing operation even before it is poured.

Also, while mixing or pouring, paint tends to pool in the annular closure channel around the can opening and subsequently affects the seal when the lid is reapplied. Common paint cans typically have a lid with an annular ridge protruding from the bottom side of the lid that seats within the closure channel in the rim of the can by a friction fit. Accordingly, when paint pools within this channel, the lid cannot properly seat within the channel and the can cannot be properly sealed. Without an improved device to prevent pooling, the painter must wipe the pooled paint from the channel before it hardens and it is no longer possible to effectively seal the can.

Because of the mess associated with pouring paint from cans and the extra cleanup that the painter must complete after pouring and mixing, there has been a desire for an improved spout that prevents paint from spilling down the side of the paint can during mixing and pouring, as well as pooling in the closure channel of the can rim.

Current conventional paint cans generally have two primary functions. The first function is to store paint so that it can be manufactured, transported, displayed, sold to a consumer, opened for use and resealed for storage and use at a later time. Its second function is distributing its contents whether with a brush or dispensing to a small hand held paint container, roller tray or paint sprayer. As stated above, the second function often times leads to spilling and therefore persons having an ordinary skill in the art desire to have an improved can or spout to combat these issues.

Most known devices on the market attempt to resolve these dispensing and mixing issues by externally mounting spouts and other devices to the inner edge of the paint can rim, which can be removed after use. For example, U.S. Pat. No. 2,767,891 describes a spout for a paint can that is removably attached to the rim of a paint can to prevent spilling during pouring. However, devices like the '891 patent necessarily require the painter to attach the device prior to pouring and remove the device after pouring is completed, and subsequently require additional cleanup of the removable spout after it is used and the can needs to be resealed. These externally mounted spouts do not allow for the can to be resealed when the device is in place, as most of the known spouts mount to the can around the rim and thereby prevent the protuberance of the lid from seating within the closure channel. Lastly, known pouring spouts, such as that described in the '891 Patent, are not intended to and do not prevent paint from pooling in the closure channel around the can opening, especially during mixing.

For example, the Shur-Line® Pour and Store Lid and the SnapNSave™ are externally mounted spouts currently on the market that attach over the entire rim of the can and replace the existing friction fit lid. The problem is that they have to be installed and removed constantly because paint requires periodic mixing and these devices do not allow access. Also, these pouring spouts are not intended to and do not prevent paint from pooling in the closure channel around the can opening while paint is mixed. Additionally, the seal of these pouring spouts are not as good as the friction fit lid that is standard with the existing paint can. Often, these devices do not perfectly fit all gallon paint cans because rim sizes are slightly different depending on the manufacturer, which leads to paint dispensing mishaps that result in the loss of large amounts of paint or cans being stored without a complete seal leading to the loss of the remainder of the paint.

The Shur-Line® Pour and Store Lid and the SnapNSave™ spouts also fail to allow use of the container's original lid. In both designs, the pouring spouts replace the standard container lid and include corresponding lids that engage the respective spouts, requiring the user to necessarily discard the original container lid. Further still, neither spout design can be retracted into the can and covered with the original lid. In the SnapNSave™ spout in particular, a planar lid is provided in place of the original paint can lid so that multiple cans can be stacked on top of one another. Accordingly, it would be beneficial to have a pouring spout that can both retract inside the can and function with the traditional can lid to allow paint cans with a spout to be stackable.

Other known devices attempt to solve pouring and mixing issues by integrating a retractable spout within the paint can, rather than having the painter attach the removable spout to the outside of the can. For example, U.S. Pat. No. 2,498,318 describes a retractable spout that freely floats within the paint can when not in use and can be pulled to the top of the can before pouring. Accordingly, the painter does not necessarily need to attach the spout prior to use and does not need to clean the spout after use, as it may remain within the can. However, there is nothing in the device of the '318 patent preventing the spout from falling to the bottom of the can, and it must be fished out and pulled to the top of the can before pouring. Additionally, when the spout is extended, it will be covered in paint, which will drain down the spout into the can rim and pool in the closure channel, thereby affecting the seal of the lid once the spout is retracted. Also, devices like these would require installation by the manufacturer and have the potential to negatively impact the mixing of the paint by the retailer since the spout would impede the flow of paint during the mixing or shaking process in the store.

Similar cans with integrated spouts include those described in U.S. Pat. Nos. 3,831,824 and 1,836,729, which effectively aid with pouring liquids from cans but which necessarily require the design of the can to be modified. Particularly, the lids of the '824 Patent and the '729 Patent are necessarily altered to accommodate the integrated spout. Accordingly, these integrated spouts are not fit for use with traditional paint cans and similarly do not allow easy mixing, which is a function of traditional paint cans. Other attempted solutions to these issues include new designs for the container, which involve changing its shape, size and assembly. These changes are very expensive to implement because they require significant changes to the existing infrastructure, including container fabrication, packaging, assembly lines, shipping layouts, storage layouts and shaker devices.

Accordingly, there remains a need for an improved spout for a paint can that can be integrated with traditional paint cans, while preventing spilling during pouring and mixing, in addition to allowing the traditional paint can to seal without modifying the original exterior of the container, specifically a traditional metal, plastic, or hybrid paint can.

SUMMARY OF THE INVENTION

The present disclosure describes a pouring assembly for a liquid container and particularly for a spout for pouring liquid, as well as other uses, from a container. For example, pouring paint from a traditional pint, quart or gallon paint can having an opening at one end. In the preferred embodiment, the pouring assembly includes a retractable spout that prevents spilling and pooling of liquid within the rim of traditional paint can and allows easy reclosing of the container with a traditional paint can lid. Where no paint pools within the channel, the lid seals in a tight manner and prevents deterioration of the remaining contents of the container, while also mitigating any loss of paint and mess during use. These functions are achieved without modifying the can or lid structure, thus maintaining the original paint can structure as manufactured, including an annular seal for a removable lid that has a friction fit engagement with a corresponding annular channel.

Another aspect of the disclosure is to provide a novel spout, which when extended functions to increase the interior volume of the container to facilitate the mixing of the contents with a mixing device, for example a wooden mixing stick, paddle mixer or similar device. This additional interior volume of the container may also be utilized to clean and remove excessive contents, such as paint, from said mixing devices. Particularly, the disclosed spout may include a brush wipe for removing excess paint from a brush after it has been dipped into the paint can.

Another aspect described herein is the novel spout that can be extended to facilitate the pouring of the contents, for example paint or stain, without dripping the paint or stain down the outside of the container or affecting the closure channel around the rim of the can once the pouring operation is complete and the can needs to be resealed. Accordingly, any excess liquid remaining on the extended spout after pouring will drip back into the container and away from the rim of the can. And once retracted, the spout is able to remain inside the container so that the spout does not necessarily need to be attached, removed and reattached to the can. Also, the spout does not require any cleaning after each use and the paint does not dry on the spout because it remains fluid inside the paint can. Since the paint can is able to be resealed easily, the paint remaining in the can does not deteriorate from being left open to the outside air which minimizes paint loss and contamination of the paint like dried flecks in the paint that are created on the inner edge of the can when left open. This dried paint inevitably flakes into the can fouling the remainder of the paint and in some instances, requires the paint to filtered to remove the contaminants.

A further aspect of the pouring assembly described herein is to provide an inexpensive container spout of simple plastic or metal construction that may be permanently or semi-permanently mounted inside of a conventional container in a retracted position. If permanently mounted inside the can, the spout would still allow the container to be sealed in its current design with no modifications to the closure, no additional openings in the container that could lead to deterioration of the remaining contents of the container, and no necessity for modification to the exterior size and shape of the container, thus allowing current assembly and manufacturing infrastructure to be used without conflict or with minimal modification. If semi-permanently mounted inside the can, the spout would still allow the container to be sealed in its current design with no modifications to the design of the closure and no necessity for modification to the exterior size and shape of the container, thus allowing current assembly and manufacturing infrastructure to be used without conflict or with minimal modification.

Further areas of applicability of the devices and methods of the present disclosure will become apparent from the detailed description provided hereinafter. It should be understood that the detailed description and specific examples, which include the preferred embodiment thereof, are intended for purposes of illustration only and are not intended to limit the scope hereof.

BRIEF DESCRIPTION OF THE DRAWINGS

The present invention disclosure will become more fully understood from the detailed description and the accompanying drawings, wherein:

FIGS. 6A and 6B show cross-sectional detail views of an edge mounted removable spout in the extended position and retracted positioned, respectively.

FIG. 6C shows a top-view of an edge mounted removable spout.

DETAILED DESCRIPTION OF THE PREFERRED EMBODIMENTS

Figures 1A, 1B:
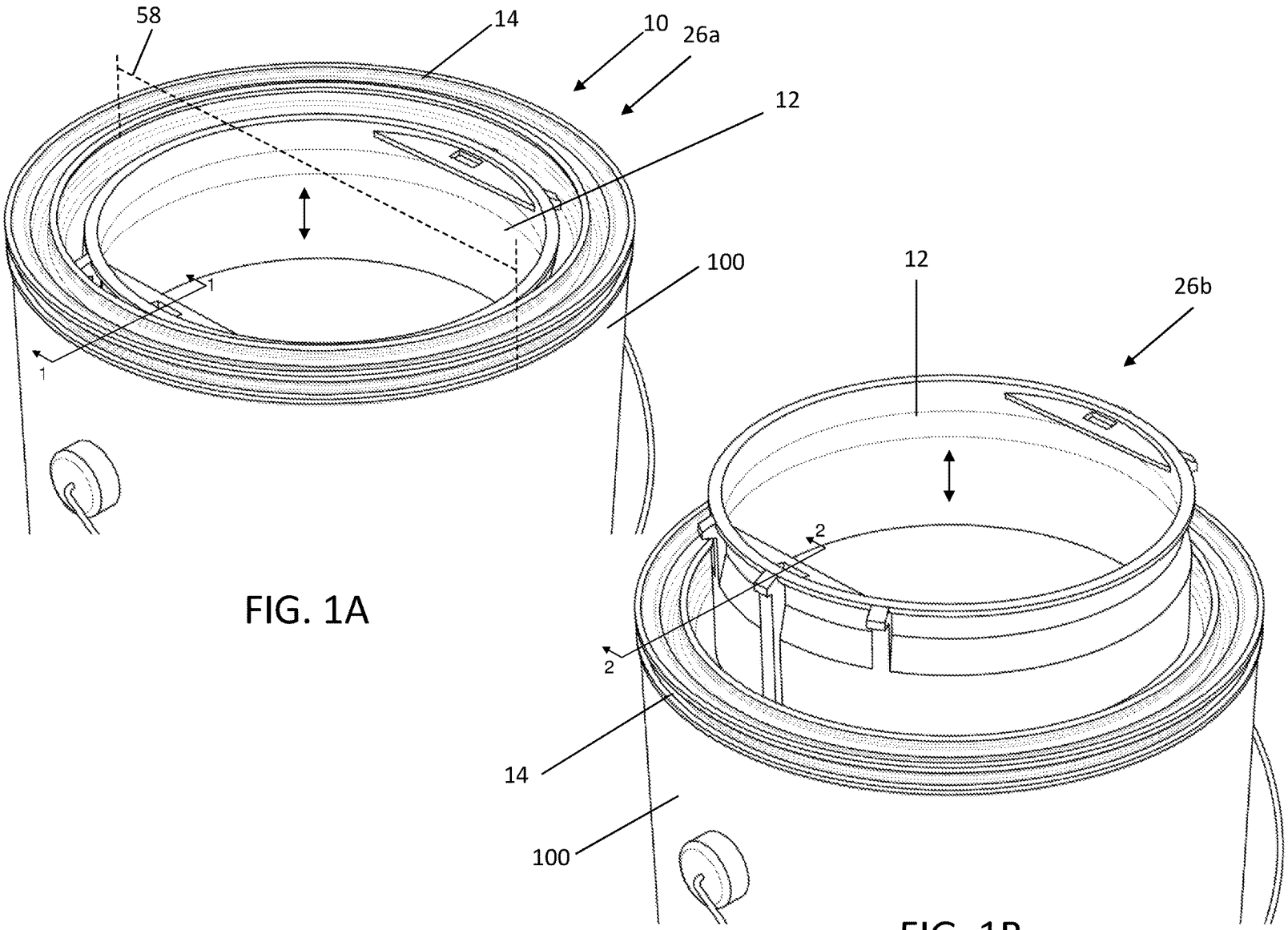
FIGS. 1A and 1B show a perspective view of a pouring assembly in the retracted position and the extended position, respectively.

The following description of the preferred embodiment(s) is merely exemplary in nature and are in no way intended to limit the invention, its application, or uses.

Example implementation of the pouring assembly in accordance with various embodiments described herein includes a retractable spout for a container. Preferably, the pouring assembly combines a spout and an annular collar with a container having a lid that seals with a friction fit in the rim of the container. In operation, the spout translates relative to the opening of the container and engages one of the rim of the container or the collar of the pouring assembly in both retracted and extended positions. The spout can be extended from the container opening to assist in pouring or provide additional container volume for mixing. Once the pouring or mixing operation is complete, the spout is subsequently moved into the retracted position within the container for later use. Subsequently, the container can be sealed with the original lid while the spout is held within the container with the top edge of the spout positioned proximate to the container opening for easy access when the container is needed again.

When in the extended position, the spout will function to increase the interior area of the container to facilitate the mixing of the contents so as not to foul the closure channel or annular rim with paint, such as while stirring with a mixing device, for example, a wooden mixing stick, paddle mixer or any similar device. This additional space also allows for a more aggressive stirring of the contents to achieve a better mix of said contents. In addition, this additional interior area of the can may be utilized to clean or remove excessive paint from said mixing devices for deposit back into the can. For example, a mixing stick used for stirring may be slidably pressed against the flat edge of the handle described below to expel paint therefrom. The additional interior area provided by the extended spout makes cleaning a mixing stick significantly easier than if using a paint can without the spout installed.

When the spout is fully extended for pouring or mixing, the bottom flange will nest and seal against the ledge bottom side of the annular collar to prevent paint from pouring out anywhere except through the opening in the spout. In the extended position, the spout projects outside of the can past the annular container rim so that when contents are poured from the can, the contents flow past the outer rim edge of the can without contacting the rim top side and exterior container sidewall of the can or fouling the annular rim and closure channel. This feature reduces or eliminates cleaning and prevents problems closing the can with the paint can lid, for example when paint has dried in the closure channel or annular rim of the can so as to interfere with the nesting of the friction fit lid.

Once dispensing of the paint is complete, the spout may be retracted back into the can by pushing down on the top edge of the spout or the handles with the user's fingers or other tool, such as a church key or a screwdriver. The tools can be utilized if the user does not want to get paint on their fingers or hands. Once the spout is retracted into the paint can, any paint remaining on the spout will drain back into the can through the gap between the spout and the ledge. The painting cycle is completed when the can is resealed with the lid. The protuberance in the lid may be frictionally fit into the closure channel of the rim or collar as described below, thereby facilitating the reclosing of the can in a tight manner to prevent deterioration of the remaining contents of the can. The spout remains in the can and ready for future use. The paint on the spout remains fresh and fluid just like the paint in the can which prevents any contamination of the paint from paint drying and flaking off into the paint which would show up during future painting and possibly ruin the paint finish.

As particularly shown in the Figures, the pouring assembly 10 is attached to a container 100, with the spout 12 positioned within the interior volume of the can and engages the rim 102 of the container or a collar 14 as further explained herein. The pouring assembly is preferably used with a conventional paint can, but it will be appreciated by those having an ordinary skill in the art that the spout may be used with any container having a suitable opening for dispensing a liquid and employing the spout.

The container preferably includes a cylindrical can body with a circumferential bottom on one end and an annular can opening on the other. The can has a single opening proximate to the top of the cylinder defined by the rim. The can opening is surrounded by a rim having a rim closure channel 114 that accepts the lid protuberance 108 when the can is sealed. The rim radially extends from the outer edge 112*a* connected to the sidewall 104 of the cylindrical body to an inner edge 112*b* positioned within the cylindrical can body. The annular closure channel is subsequently spaced a distance 116 from the outer rim edge between the inner and outer rim edge and the friction fit lid nests within the annular closure channel in the closed position.

Accordingly, the preferred container also includes a traditional paint can lid 106 that has a lid protuberance 108 proximal to the periphery of the lid that mates with the rim of the can. In operation, the lid protuberance seats within the annular closure channel of the rim and is secured with a friction fit. Alternatively, as further explained below, the lid protuberance seats within the annular collar channel 44 in embodiments having a top mount collar 14*a*. Regardless of the assembly embodiment, when the lid is removed, the opening at the top of the can permits access to the paint contained within the can and the can is sealable with the originally provided lid.

The spout is receivable within the container and includes a cylindrical sidewall 30, a top 28*a* and bottom 28*b* edge, a bottom flange 32 protruding from the bottom edge and at least one tab protruding from the top edge. Preferably, the sidewalls of the spout form a solid cylindrical body 12*a* but it will be appreciated that other spout configurations may be used as further described herein. The tabs 16 are positioned proximate to the top edge of the spout and extend a tab width 50 from the exterior sidewall. Preferably, the tabs include a flat bottom portion 72*a* for engaging the collar ledge. The bottom flange protrudes a bottom flange width 48 from the exterior sidewall 30*a* of bottom edge of the spout, opposite from the tabs. As further described herein, the spout is supported by the tabs as they rest on the rim of the container when the spout is in the retracted position. Conversely, the bottom flange 32 engages the bottom side 110*b* of the rim when the spout is extended. Further still, the flange may also have a curved shape for embodiments that seal against the irregularly shaped bottom side of the rim.

In operation the spout translates between an extended position 26*b* and a retracted position 26*a* relative to the rim of the container. When the spout is retracted, the tabs engage a topside 110*a* of the rim and suspend the spout from the rim with the top edge of the spout proximate to the can opening. However, the top edge of the spout does not interfere with the rim channel so as to allow the friction fit lid to seal without interference. In the retracted position the bottom flange is disengaged from the bottom side of the rim. In the extended position, the top edge of the spout protrudes through the can opening and the bottom flange sealingly engages the bottom side of the rim. When fully extended, the bottom flange prevents the spout from being pulled completely through the opening. Thereby, liquid may be poured from the container while the extended spout prevents liquid from spilling down the side of the can body or unintentionally entering the annular closure channel of the rim, as described further herein.

The pouring assembly may also include a collar attached to the rim of the container. As particularly shown in the drawings, the collar can be a top mount collar or a bottom mount collar. As shown in FIG. 1, the top mount collar 14*a* is connected to the top of the rim. Conversely, as shown in FIG. 2, the bottom mount collar 14*b* is connected to the bottom side of the rim channel 120. In addition, the collar may be integrated 78*a* with the rim when the container is being manufactured or added as a permanent 78*b* or removable 78*c* aftermarket product, respectively illustrated in FIGS. 7A, 7B and 7C and described below.

Regardless of the particular collar embodiment, the collar includes an outer collar edge 38*a* positioned proximate to the outer edge of the rim, an inner collar edge 38*b* positioned proximate to the inner edge of the rim and a ledge 20 that radially extends a ledge width 52 from the inner collar edge beyond the inner edge of the rim and into the opening of the container. The ledge includes a topside 20*a* and bottom side 20*b* which respectively engage the spout tabs and the bottom flange as the spout moves between the retracted and extended positions. As explained with reference to the rim of the container above, when a collar is included in the pouring assembly the tab engages the topside of the ledge and the bottom flange is disengaged from the bottom side of the ledge when the spout is in the retracted position. Conversely, the bottom flange sealingly engages the bottom side of the ledge and the tabs are disengaged from the topside of the ledge when the spout is in the extended position. In addition, the ledge of the collar can also be slightly sloped to drain contents back into the can when the spout is retracted, as further described herein. Similarly, the bottom flange 32*a* may also be sloped to match the slope of the ledge in order to provide an improved seal.

In the embodiment shown in FIG. 1, the annular collar is friction fit within the rim closure channel and suspends the spout within the interior volume of the can before and after paint has been deposited in the can. In this embodiment the annular collar is not permanently integrated into the can, and instead, snaps into place and is removable so that the collar may be sold as an aftermarket product, such as when a painter buys a traditional can and manually installs the annular collar and a spout as an attachment to the can. As described above, the collar ledge extends from the inner edge of the annular collar towards the interior volume of the can and protrudes past the inner edge of the rim of the can. Accordingly, the ledge creates an L-shaped shelf around the inner edge of the rim with a diameter 56 smaller than the diameter 58 of the existing can rim.

The collar embodiment shown in FIG. 1 particularly includes a collar protuberance 42 extending from the bottom side of the collar 40*b*, a collar closure channel 44 recessed from the topside 40*a* of the collar and aligned with the protuberance below. When connected to the container, the collar protuberance seats within the rim closure channel that traditionally accepts the lid protuberance. Although the lid protuberance cannot seat within the rim channel in this arrangement, the can may still be closed as the lid protuberance can seat within the collar closure channel that is aligned with the rim closure channel as shown in FIG. 1D.

Figure 1C:
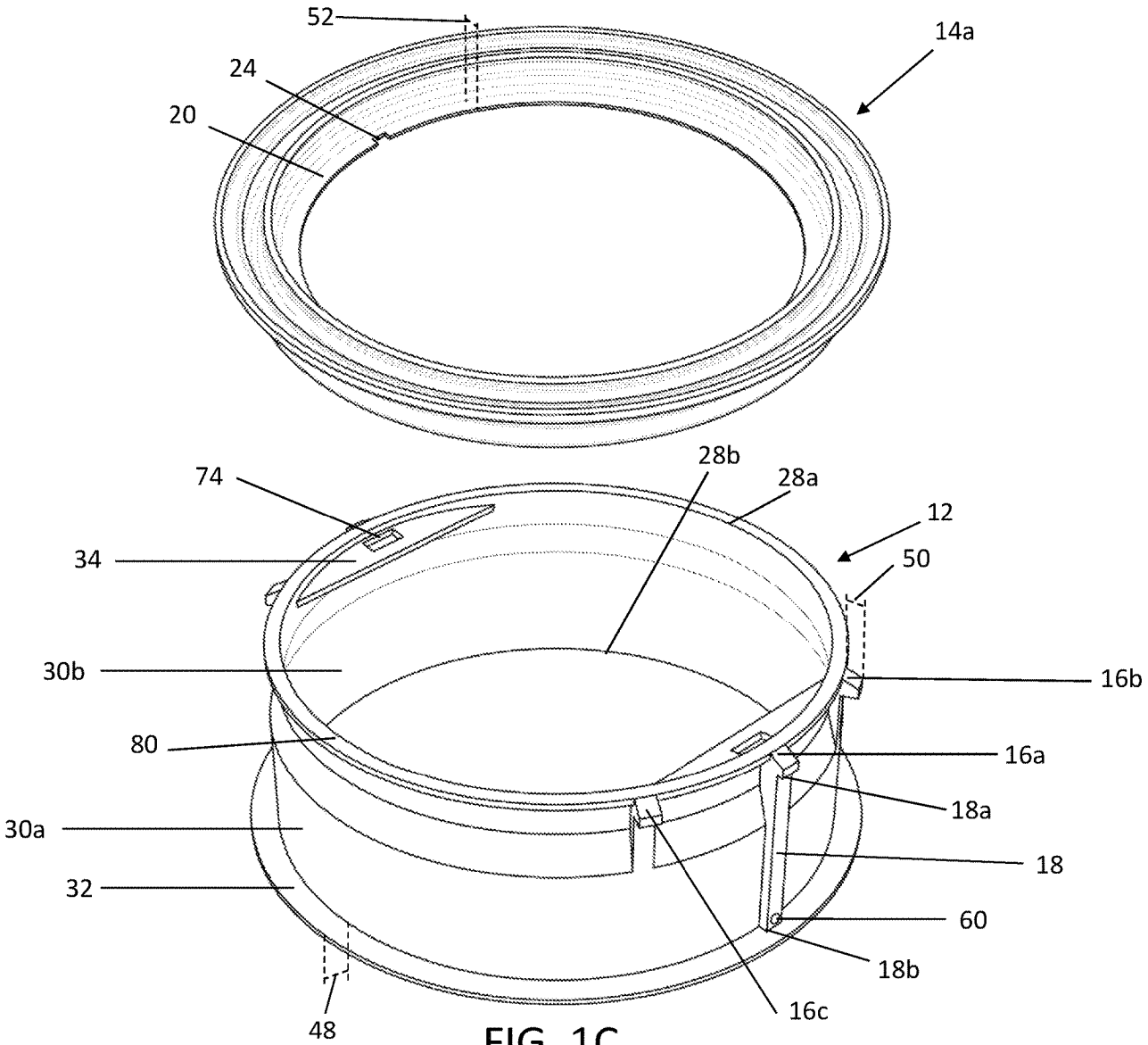
FIG. 1C shows an exploded view of a pouring assembly.
Figure 1E:
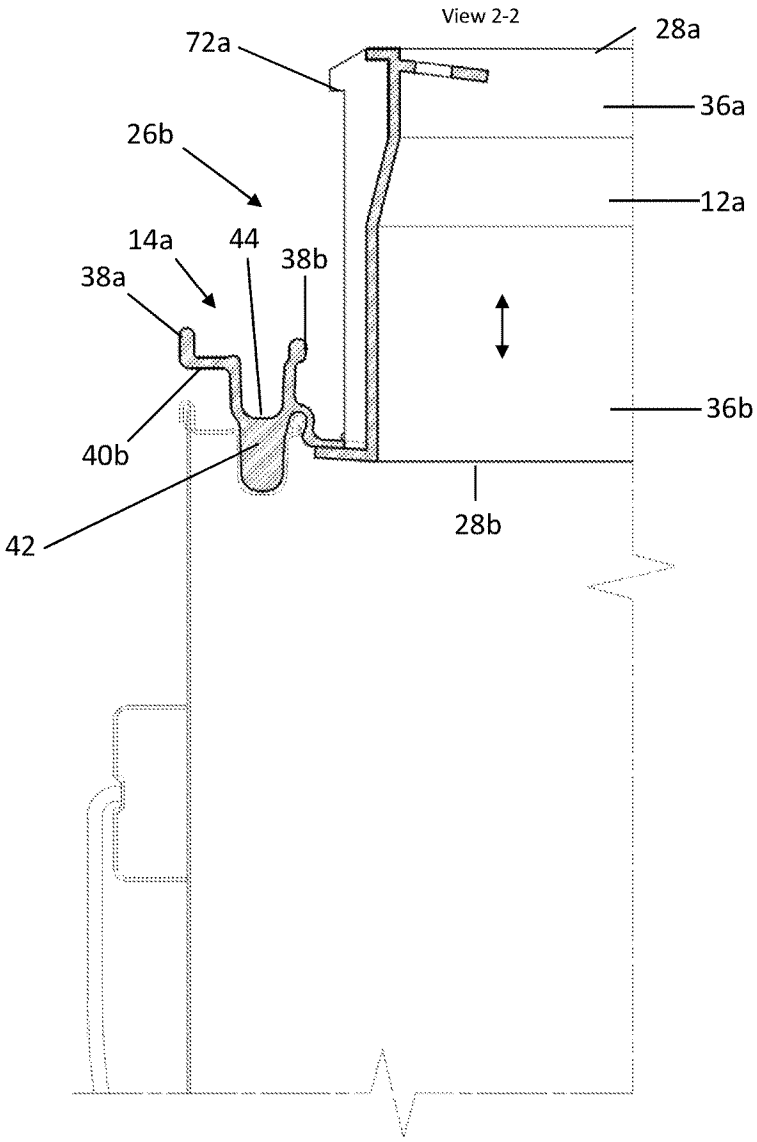
FIGS. 1D and 1E are cross-sectional views of a pouring assembly in the retracted position and the extended position, respectively.
Figure 1D:
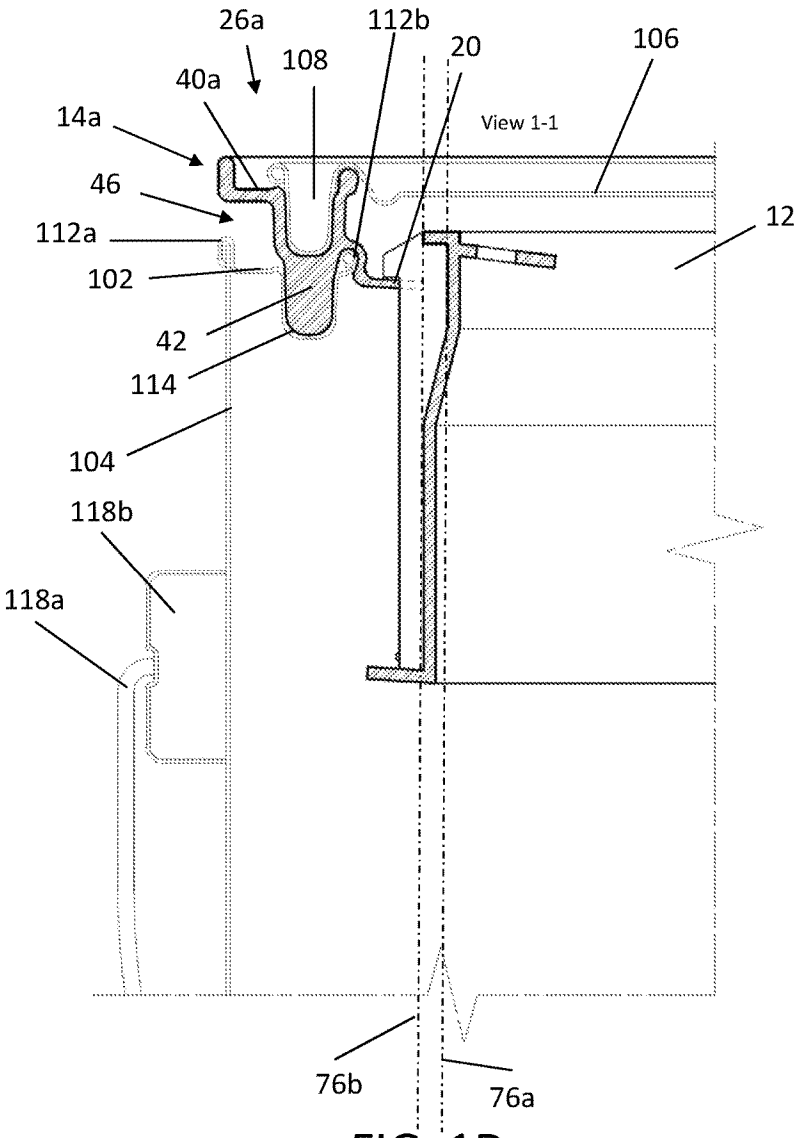

As shown in FIGS. 1D and 1E, upon installation of the pouring assembly, the annular rim of the can receives the friction fit annular collar protuberance with the collar ledge extending beyond the inner rim edge and inner collar edge into the can opening. In addition, the ledge is slightly angled towards the interior volume of the can to drain any contents between the inner edge of the collar and the spout back into the can. This separable annular collar is friction fit to the rim closure channel with radius sections nesting over the inner edge of the rim.

In addition, collar tool cutout openings or a recess in the outer edge of the collar or a space 46 between the bottom side of the collar below the outer collar edge and the outer rim edge can be incorporated to allow for the easy removal of the device by inserting a standard church key or screwdriver into the opening, recess gap or space. Once inserted, the collar can be removed by pressing down on the rim and pushing up against the annular collar which will pull the collar protuberance out of the rim closure channel.

Figure 2A:
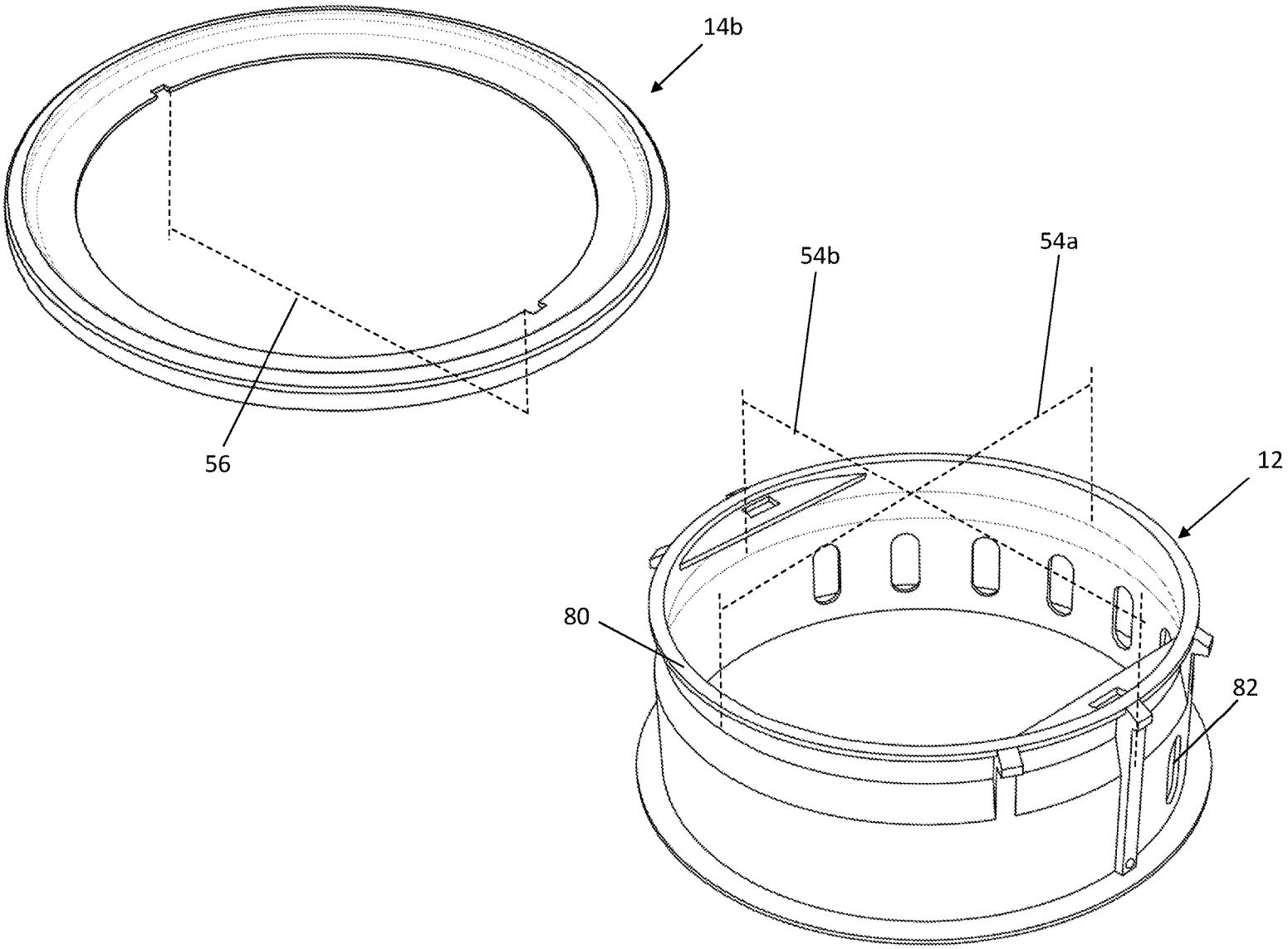
FIG. 2A shows an exploded view of an alternative pouring assembly.
Figure 2C:
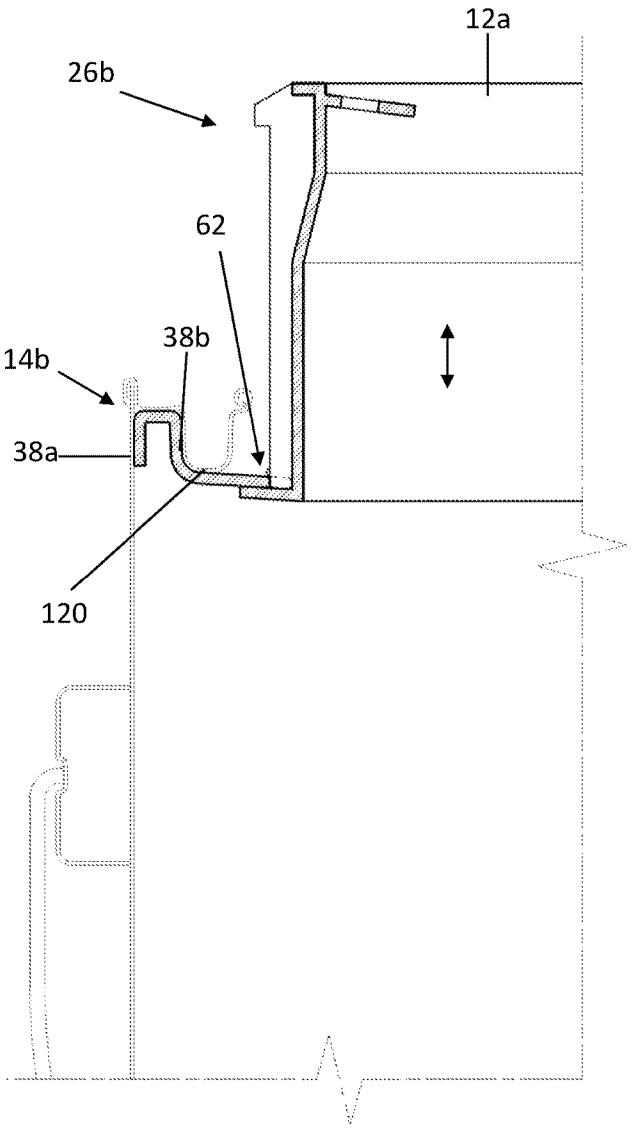
FIGS. 2B and 2C are cross-sectional views of an alternative pouring assembly in the retracted position and the extended position, respectively.
Figure 2B:
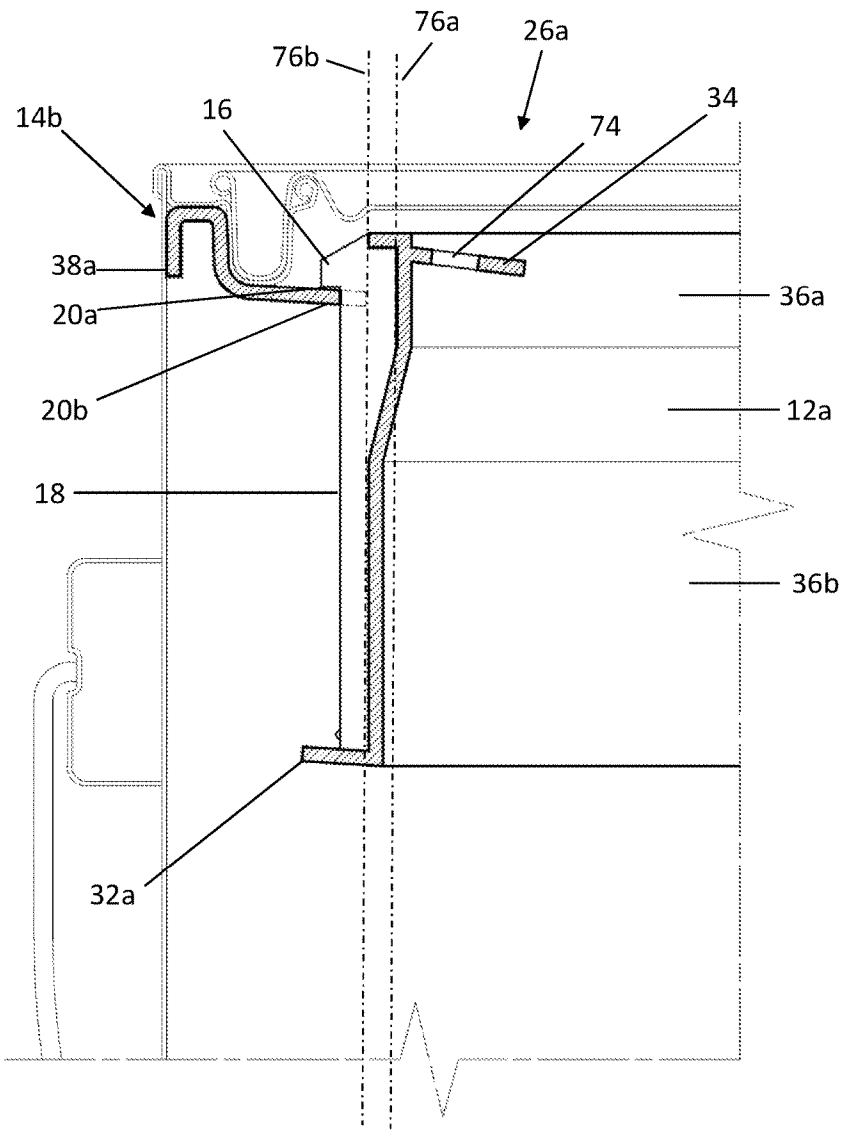

In another variation of the pouring assembly shown in FIG. 2, both the spout and annular collar are contained within the interior volume of the can. In this embodiment the collar may be integrally formed with the body of the can during manufacture or the collar can be fitted into the can as an aftermarket product, such as when a painter buys a traditional can and manually inserts the annular collar and a spout as an attachment to the can. As shown in FIGS. 2B and 2C, the annular collar has an outer edge that abuts the interior sidewall of the can beneath the rim with a ledge extending towards the interior volume of the can and protruding past the inner edge of the rim.

Figure 3B:
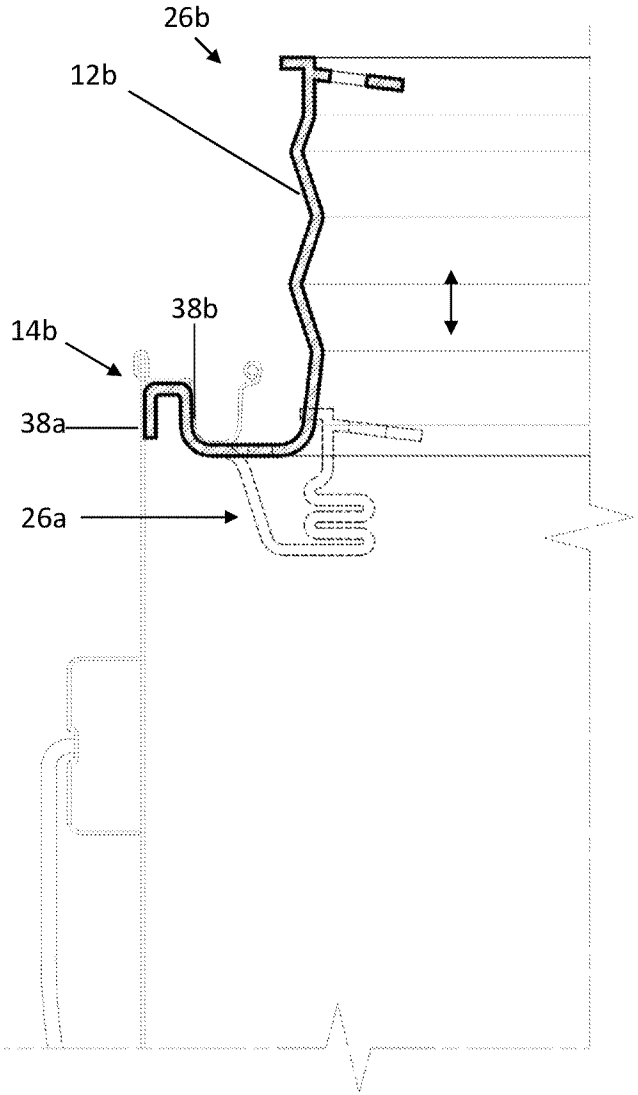
FIGS. 3A and 3B are cross-sectional views of alternative spout embodiments.
Figure 3A:
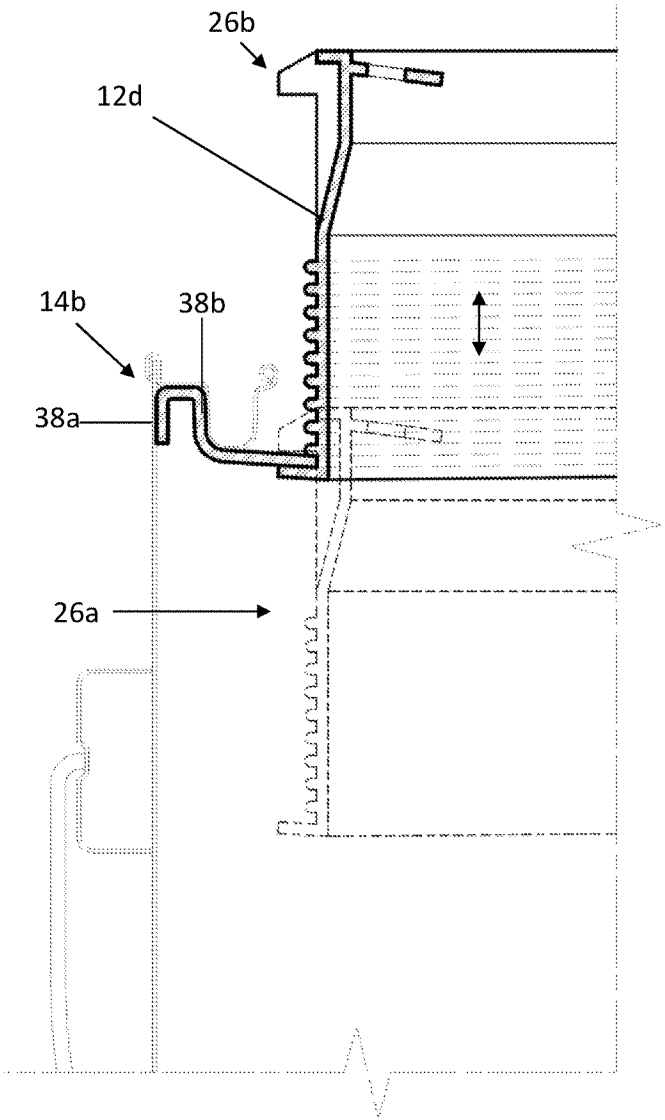

The bottom mount collar shown in FIG. 2 nests within the space between the interior of the can sidewall, bottom side of rim and bottom side of the rim closure channel. As with the top mounted collar, the ledge extends into the can opening and is slightly angled towards the interior of the can to drain any contents back into the interior of the can. This bottom mount collar may be friction fit, glued, adhered, welded or mechanically fastened to the bottom side of the annular rim. Depending on the nature of the attachment, the annular collar may be removable and transferrable to other cans for additional use, and is preferably made of metal or plastic In additional alternative embodiments shown in FIGS. 3, 4, 5 and 6, the spout may be screwed 12*d* or fold like an accordion 12*b* as it moves between extended and retracted positions. As shown in FIG. 3A, the spout has been modified with threads to extend and retract the spout, wherein the threads on the spout engage corresponding threads on the ledge of the annular collar. This screw variation further secures the spout when extended. Conversely, no threads may be used and the spout may be connected to the annular collar at the ledge and fold relative thereto via accordion folds as the spout is moved from the unfolded and extended position to the folded and retracted position. Further, the spout body may include multiple telescoping sections wherein the spout telescopes between the retracted and extended positions. It will be appreciated by those having an ordinary skill in the art that these various spout configurations could be used with any one of the top mount or bottom mount collars.

In the accordion fold embodiment of FIG. 3B, the bottom edge of the combined collar and spout assembly may be integrated with the can or may snap into the bottom side of the rim as described with reference to other embodiments described herein. The combined collar and spout may extend like an accordion or be simplified with a flexible transition between the annular collar and the spout so that the spout is able to flip up into an extended pouring position. For example, a semi-rigid rubber or similar material can be used which would allow the spout to extend and remain sturdy during pouring while also being flexible enough to collapse into the retracted position. In either embodiment, drain holes may be provided between the inner edge of the paint can rim and the exterior sidewall of the spout to allow paint to drain back into the interior of the can.

Figures 4A, 4B, 4C:
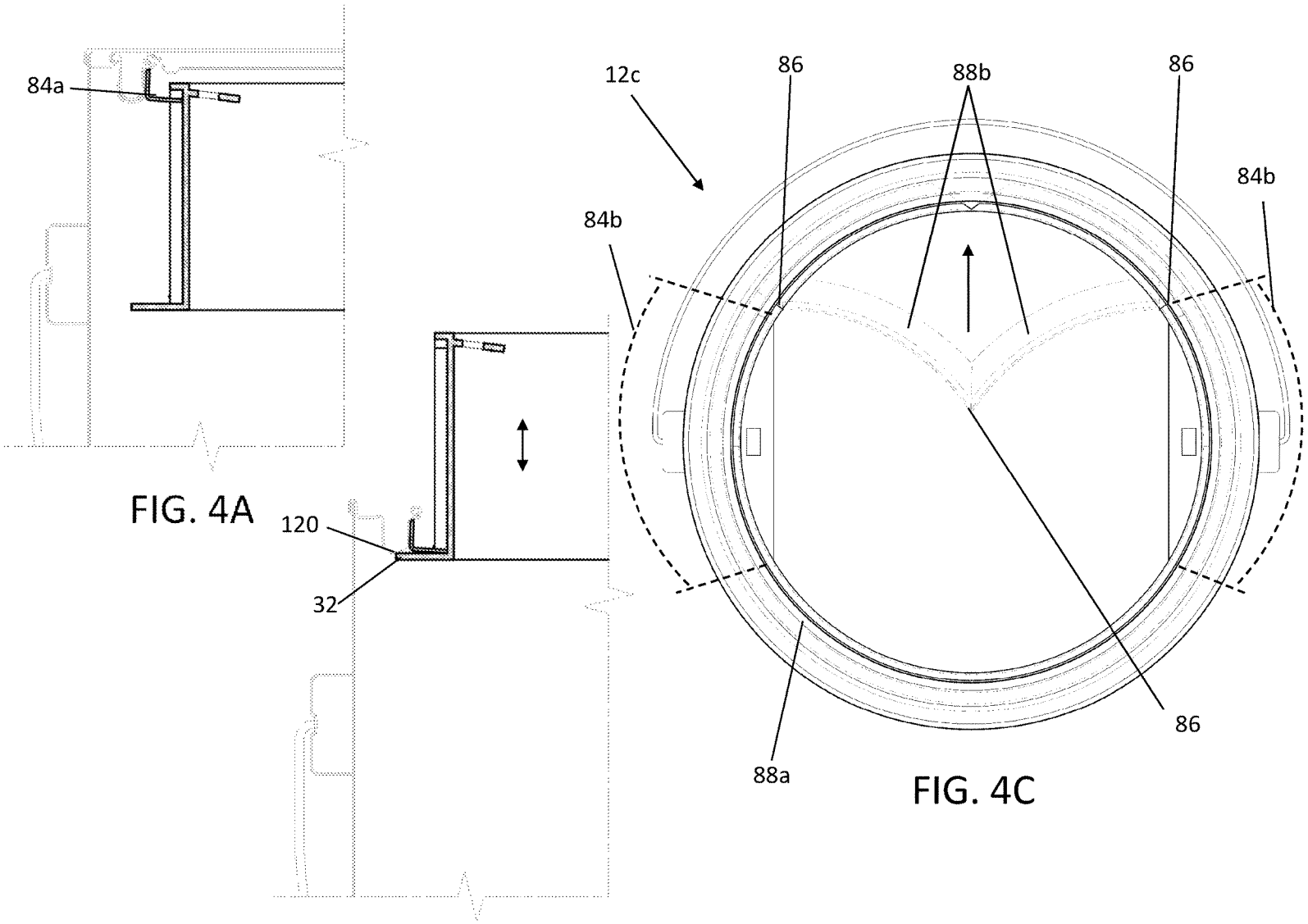
FIGS. 4A and 4B show cross-sectional detail views of a tab mounted removable spout in the extended position and retracted positioned, respectively.
FIG. 4C shows a top-view of a tab mounted removable spout.

In another alternative embodiment shown in FIG. 4, the annular collar is replaced with mounting tabs 84*a* that are connected to the rim and engage with the tabs on the spout. As shown in FIG. 4C, the mounting tabs partially extend a distance 84*b* around the circumference of the rim and are preferably aligned with the container handle and mounting ears. The mounting tabs may be permanently or semi-permanently attached to the existing annular rim of the paint can and serve to hold the spout in close proximity to the annular rim of the paint can in place of a complete annular ledge. The spout may contain similar features to the preferred embodiment, except the size may be modified or the design simplified. In addition, the bottom flange of the spout may seal against the bottom side of the rim closure channel as shown in FIG. 4B, wherein the tabs may not extend around the entire circumference of the rim.

In the alternative embodiments shown in FIGS. 4, 5 and 6, a folding spout 12*c* may include hinge points 86 and be removable. The spout in FIG. 5 is installed as an aftermarket product, and the tabs have been replaced with hooks 72*b* integrated into the top edge of the spout. When retracted, the hooks engage the inner edge of the rim and hold the spout proximate to the can rim. The spout of FIGS. 4 and 5 have two hinge points that form a fixed spout section 88*a* and two movable spout sections 88*b* so that the radius of the spout may be reduced thereby to fit within the inner rim of the paint can. The spout is lowered into position just below the annular can rim with these sections folded via the hinge points towards the center of the can. These hinged sections are adjusted back into place after insertion in the can to enable completing of the radius of the spout. The hinged sections may be located on one side of the attachment, and the other side may remain solid, without hinges, to facilitate dispensing paint or other contents from that side without spilling, for example. In this embodiment, the hooks may interlock over the top inner edge of the can rim, which may diminish the rim sealing efficiency since the hooks do not form a continuous surface below the lid.

As shown in FIG. 6, another hinged variation of the spout may include only one hinged section, and the tabs may be replaced with a continuous circumferential flange 72*c* at the top edge of the spout that interlocks with the inner edge of the can rim. The spout may have one hinge point and a closure clip 94 on the other end of the hinged spout section so that the radius of the spout may thereby be reduced to fit within the inner rim of the paint can. The spout is lowered into position just below the annular can rim, with the hinged section pivoted towards the center of the can. The hinged section is then pivoted via the hinge so as to complete the radius of the spout, similar to the embodiment shown in FIGS. 4 and 5. Once installed, the rim of the spout forms a continuous circular outer edge that may be interlocked over the inner edge of the annular can rim so as to maintain the seal of the can.

Figures 5A, 5B, 5C:
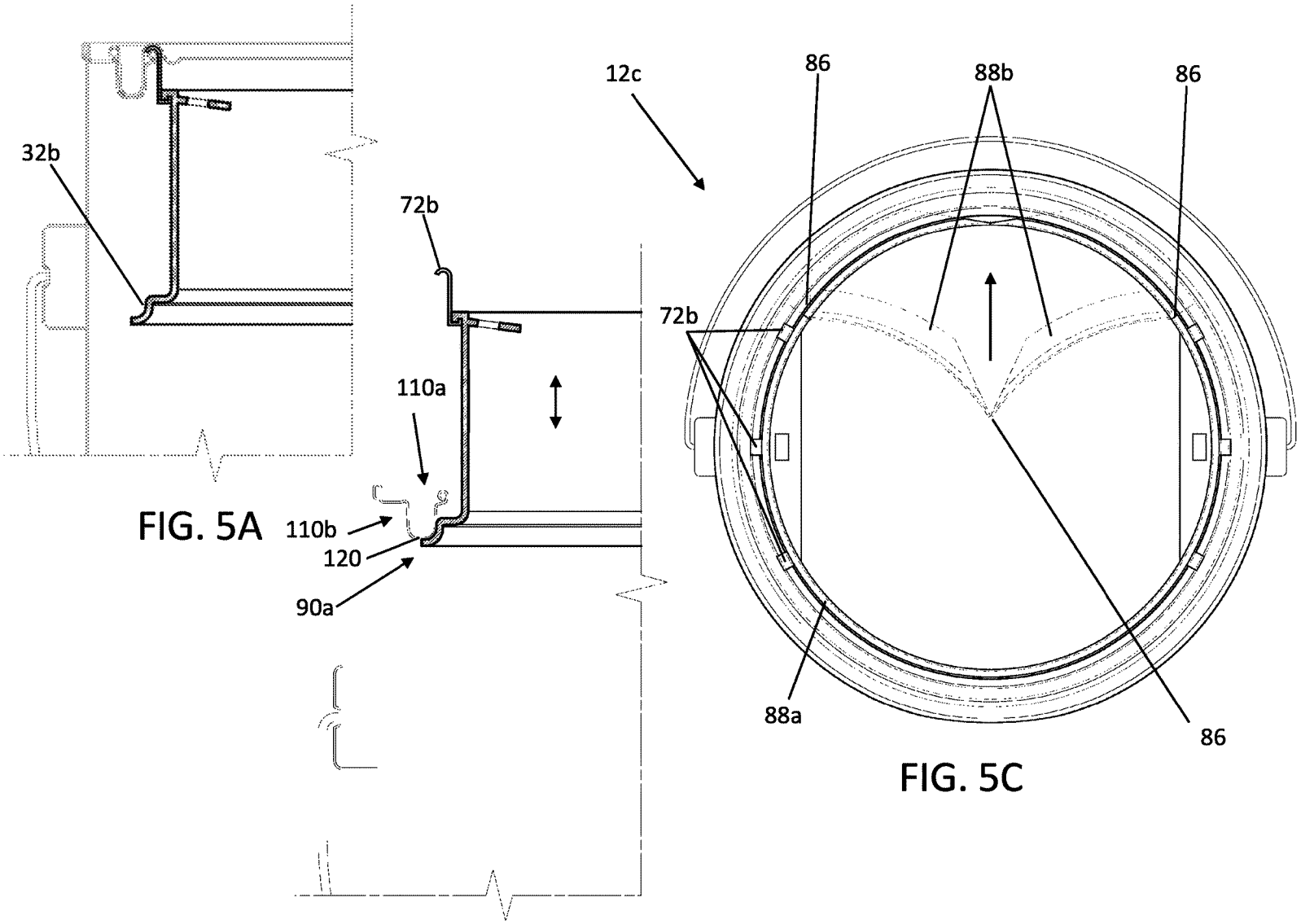
FIGS. 5A and 5B show cross-sectional detail views of an alternative removable spout in the extended position and retracted positioned, respectively.
FIG. 5C shows a top-view of an alternative removable spout.

In the embodiments illustrated in FIGS. 5 and 6 the bottom spout flange is shaped to sealingly engage the bottom side of the closure channel of the container rim. Although a substantially planar flange is preferably included in the majority of the spout embodiments discussed herein and may be used in the embodiments shown in FIGS. 5 and 6, it will be appreciated by those having an ordinary skill in the art that a curved flange 32*b* provides additional contact surface area between the flange and bottom side of the rim closure channel as shown in FIGS. 5A and 6A. Accordingly, such curved flanges provide an improved seal between the bottom side of the non-planar rim when no ledge is provided. In particular, the curved flange shown in FIG. 5A contacts a portion 90*a* of the bottom side of the rim closure channel when the spout is in an extended position as shown in FIG. 5B. Conversely, the curved flange shown in FIG. 6A contacts the entire bottom side 90*b* of the rim closure channel when the spout is in an extended position as shown in FIG. 6B. It will be appreciated that the flange designs shown in the drawings are not inclusive of all possible flange designs and are included as illustrations of varying flange shapes that can be incorporated into a pouring assembly.

The annular collar is preferably continuous around the rim of the can with the ledge protruding into the container opening to support the retractable spout. Accordingly, the ledge has a diameter that is less than or equal to the diameter of the rim. The preferred spout design includes an upper body portion 36*a* and a lower body portion 36*b* which respectively have differing diameters as particularly shown in FIG. 1E. The bottom flange is connected to the bottom portion and the bottom portion has diameter 54*b* as shown in FIG. 2A approximately equal the diameter of the ledge. The bottom portion extends along a plane 76*b* as shown in FIG. 1D parallel to the body of the can to the narrowing upper portion. Accordingly, the upper portion narrows from the bottom portion to another plane 76*a*, as shown in FIG. 1D, and has an upper portion diameter 54*a*, as shown in FIG. 2A, along the top edge of the spout that is less than the diameter of the lower body portion.

The narrowed upper portion of the spout creates a gap between the ledge of the annular collar and the spout when the spout is in a retracted position so as to allow any paint that spills between the spout and inner edge of the collar to drain back into the interior of the can when the spout is in the retracted position. Conversely, as the bottom portion of the spout has a substantially equal diameter to the inner diameter of the annular collar, when the spout is extended the exterior sidewall of the bottom portion of the spout scrapes against the edge of the annular collar and any paint thereon is thereby scraped from the spout and returned to the interior of the can. In addition, the bottom portion of the spout may have a friction fit between the exterior sidewall of the spout and the inner edge of the collar ledge where the ledge and bottom portion diameters are substantially equal. Thus, the spout friction fit further secures the spout in the extended position but it is preferred that another locking feature, such as the guiderail friction fit, ball detent or slide lock is provided wherein the diameter of the containers may vary in size.

In another aspect of the pouring assembly, a guiderail 18 protrudes from the exterior sidewall of the spout between a top end 18*a* proximal to the top edge of the spout and the bottom end 18*b* proximal to the bottom flange of the spout. In operation, the guiderail translates through a notch 24 in the ledge of the collar and prevents the spout from unwantingly rotating within the assembly. Two notches in the ledge serve as guide openings for corresponding guiderails on the sidewall of the spout. These notches located on the centerline of the can and may be aligned with the container handle 118*a* and attachment ears 118*b* to maintain the desired orientation for pouring the contents with the spout. As shown in the Figures, the guiderail is preferably positioned beneath the center tab which also aligns with the container handle attachment ears but it will be appreciated that the guiderail may be positioned at any location on the exterior of the spout. Further, the notch identifies the correct installation alignment for the spout particularly when a pouring lip is provided on the top edge of the spout as explained below.

Although the position and number of guiderails may vary, the preferred embodiment includes two guiderails and at least two corresponding notches preferably located on each side of the pouring spout in order to maintain a desired orientation of the spout relative to the can to ensure proper pouring of the contents with the spout. For example, in the embodiments shown in FIGS. 1 and 2, the spout includes six tabs and two guiderails. As shown, the guiderails extend from a center tab 16*a* with a pair of additional tabs 16*b* & 16*c* positioned on opposite sides of the center tab. When retracted, each of the tabs engage the ledge of the collar and hold the top edge of the spout proximate to the rim of the can.

Among other purposes, guiderails minimize the amount of frictional contact between the annular collar and the spout when the spout is in the retracted position by providing a gap so that the spout does not become fixed or attached to the annular collar if the paint thereon dried while the spout was retracted. Prying the spout will free these guiderails from the collar as noted below.

The top edge of the spout may also include an annular pouring lip 80 that provides a drip point on the exterior top edge of the spout to minimize paint dripping when pouring. When mixing openings 82 are provided within the spout, it will be appreciated that the pouring lip is on the opposite side of the spout body as shown in FIG. 2A. Additionally, the interior edge of the pouring lip allows a painter to wipe or scrape excess paint from a brush as the brush is wiped across it after having been dipped into the paint in the interior of the can, thus avoiding the potential of fouling the closure channel of the can. This annular pouring lip also functions as a prying contact point for a screwdriver or standard church key in order to provide leverage for moving the spout into the extended position if it were ever adhered to the ledge by dried paint.

Further, the guiderails may also include one or more features to hold the spout in the extended position. For example, the guiderail may be sized to provide a friction fit 62 with the notch and thereby hold the spout in the extended position. Further, a ball detent 60 may be provided on the bottom portion of the guide as shown in FIGS. 1D and 1E. When extended, the ledge will be secured between the bottom flange and the ball detent and the spout will not be able to retract unless sufficient force is provided to push the ball detent past the ledge when moving the spout into the retracted position. Conversely, another ball detent may be located on the guiderail proximate to the top edge of the spout to further hold the spout in place in the retracted position.

In the alternative embodiment shown in FIG. 8, the spout may include a sliding lock 64 in place of the ball detent. One lock stop is provided on each side of the notch and a space 66 is provided between the bottom of the guiderail and the bottom flange of the spout, as illustrated in drawings 8C and 8D, respectively. Accordingly, the spout is able to twist and interlock with the collar ledge. FIG. 8B illustrates the spout that has been extended and twisted clockwise until it hits the stop in the fully extended and locked position. As particularly shown in FIG. 8C, one of the lock stops 68*a* is aligned with the notch whereas the other lock stop 68*b* is removed from the notch. Thus, the slide lock can be quickly and easily moved between the locked orientation 70*a* and unlocked orientation 70*b* without unnecessary user alignment wherein the guiderail abuts the lock stop proximate to the notch and aligns the guiderail with the notch.

In operation the spout guiderails translate within the notch 24 of the collar as it is raised from its retracted position. However, when the spout is fully extended, the spout rotates and the collar ledge slides within the space between the top of the bottom flange and the bottom edge of the guiderail into a locked orientation when the guiderail hits the lock stop 68*b* on the ledge that is offset from the notch. This system allows the spout to be raised and subsequently twisted into a locked orientation to allow the user to know that the spout is in its proper pour position as well as hold the spout in the extended position.

Figure 8B:
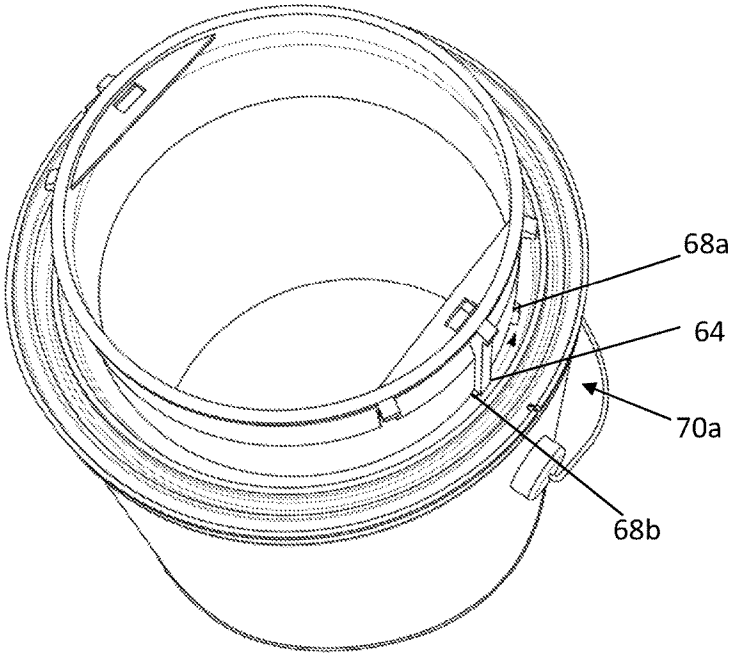
FIGS. 8A-8D depict an alternative pouring assembly embodiment having a slide lock.
Figure 8D:
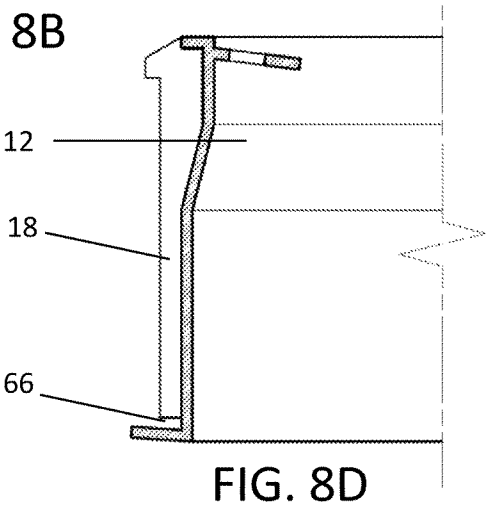
Figure 8A:
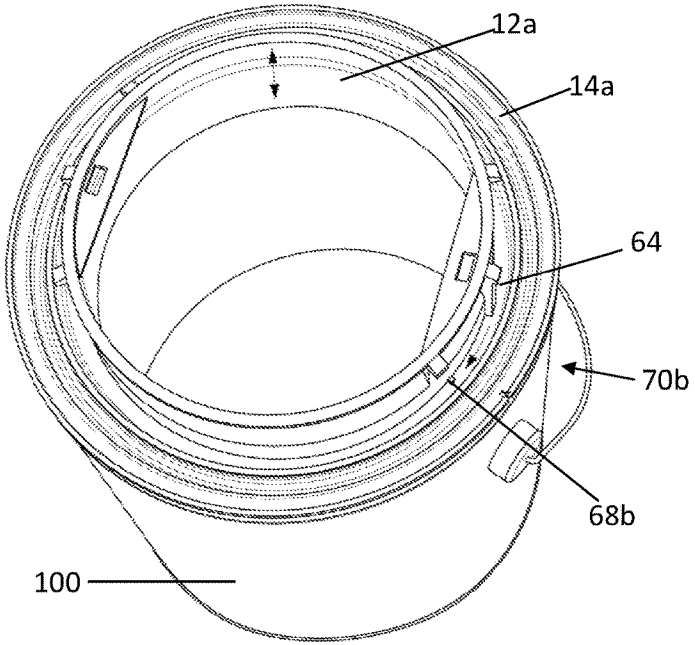
Figure 8C:
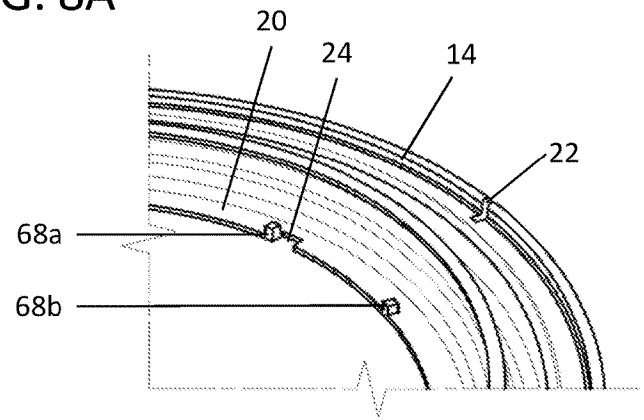

In embodiments having the sliding lock, it will be appreciated that the collar and spout alignment within the can will change to facilitate the proper pouring position. To assure the pouring assembly is properly aligned within the container, collar embodiments may include alignment guides as shown in FIG. 8. The alignment guides 22 may be a cutout in the outer edge of the collar, raised portion of the collar edge, or may be painted or otherwise printed onto the collar. Accordingly, the user can align the alignment guides with the container handle ears when mounting the collar and be assured that the spout will be in the proper pouring position when it is extended, twisted and locked. When the notches are properly aligned in embodiments having the sliding lock, the spout is offset in the retracted position but when the spout is raised and twisted in the extended position, the guides rails and tabs on the spout align with the can ears and container handles as well. When all of these are aligned, the two pour edges will be in the proper position as shown in FIG. 8B.

Planar handles 34 are provided on the interior sidewall 30*b* of the spout proximate to the top edge, as shown in FIGS. 1C and 2A. Preferably two planar handles are provided as chords on each side of the spout. In addition, the handles include tool cutout apertures 74 that are aligned with the alignment guides. These handles allow an individual to extend the spout into pouring position by using their fingers or by using a church key or screwdriver inserted through the tool cutout to pull the spout up. These tools can be utilized if the user does not want to get paint on their fingers or hands. And as not to interfere with the lid when the can is closed, the grasp tabs are planer and located just below the annular pouring lip and slope down slightly to allow any paint accumulating thereon to drain back into the interior of the can if any were to fall on the handles.

In addition, the spout may also include a number of mixing openings 82 on one side, as shown in FIG. 2A. These mixing openings are positioned in the lower portion of the spout body and allow paint to mix thoroughly when tilted and shaken at the store when the spout is permanently mounted inside the can. In such an embodiment it will be appreciated that pouring should only occur from the side of the spout that does not have any mixing openings.

The alternative embodiment shown in FIG. 2, as explained above, is a metal or plastic annular collar that is transferrable or permanently installed within the can. As previously stated, this separable annular collar may be friction fit, glued, adhered, welded or mechanically fastened to the bottom side of the annular rim or closure channel of the can. This embodiment enables both the annular collar and spout to be mounted within the can. The protuberance in the lid in this case may be frictionally fit into the rim closure channel, thereby facilitating the reclosing of the can in a tight manner to prevent deterioration of the remaining contents of the can. The spout remains in the can and ready for future use. This interior mounting maintains the existing closing of the can and eliminates the addition of any air infiltration points.

Figures 7A, 7B, 7C:
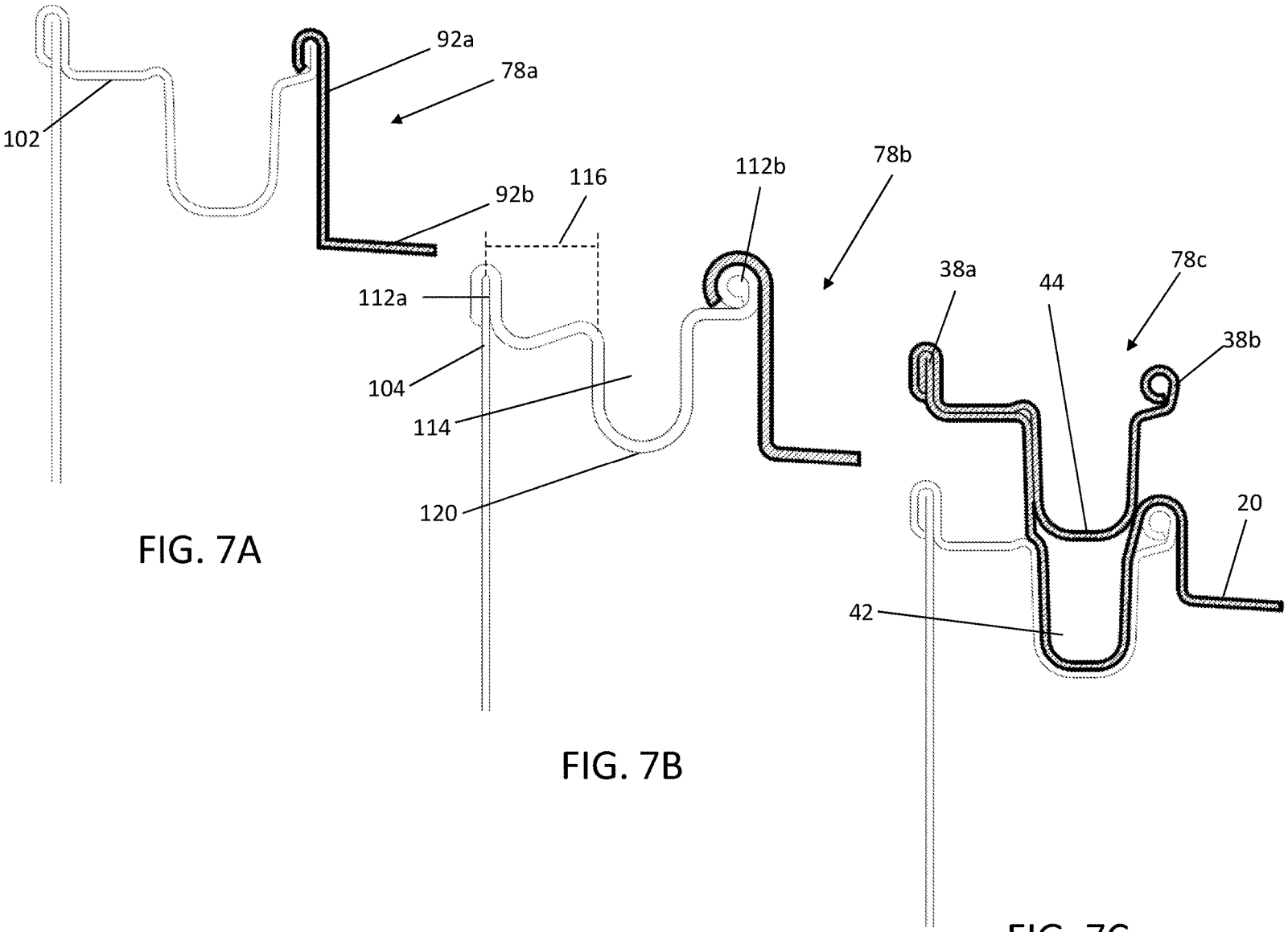
FIGS. 7A-7C are cross-sectional detail views of annular collar variations according to the pouring assembly described herein.

Regardless of whether the collar is integrated during manufacturing as shown in FIG. 7A or added as an aftermarket product as in FIGS. 7B and 7C, the annular collar can be connected to the can rim by modifying the inner edge to receive an L-shaped collar 92. The vertical leg of the L-shaped collar may also be bent outwardly around and rolled over the inner edge of the rim, such that the vertical leg 92*a* nests to the back side of the rim closure channel. The other leg 92*b* of the L-shaped collar provides the collar ledge which engages the spout as described herein. In addition, the ledge of the collar can also be slightly sloped to drain contents back into the can when the spout is retracted.

As shown in FIG. 7A and referenced above, a metal annular collar can be integrated with the rim of the can. The integrated annular collar is connected by modifying the inner edge of the rim to receive a vertical metal leg of the annular collar, thereby creating an internal peripheral flange similar to the external peripheral flange on the outer edge of the rim. As shown in FIG. 7A, the inner edge of the collar is bent inwardly around and rolled over the inner edge of the rim and thus forms an integrated collar.

Alternatively, the annular collar may not be integrated into the can and instead snaps into place as a permanent or removable attachment where the collar may be sold as an aftermarket product. In this embodiment, the inner edge of the paint can remains in its current design and the annular collar snaps into place over the inner edge and can be designed to permanently attach or removable attach to the rim of the container.

Further variations of integrated, permanent or temporary collars can include a collar channel that seats within the rim closure channel as shown in 7C and particularly described with regard to FIG. 1 above. Accordingly, various designs may provide a collar that is integrated with the rim during manufacture, permanently added later or temporality attached to the rim of the container. As indicated above, persons having an ordinary skill in the art will appreciate that various pouring assemblies may be made of different types of materials including but not limited to plastic and metal. In addition, the type of material used may be determined by the intended use, desired connectivity, size and intended durability of the pouring assembly. For example, it will be understood that more durable metal may be preferred for pouring assemblies that are intended to be permanently integrated with a can. Similarly, a metal assembly may be better suited for a can that is manufactured to include a pouring assembly wherein the present state of the art in paint can manufacturing is to use metal. Conversely, it may be more beneficial to provide a lightweight aftermarket plastic pouring assembly that is easier for a user to install on their own.

The embodiments were chosen and described to best explain the principles of the invention and its practical application to persons who are skilled in the art. As various modifications could be made to the example embodiments described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described example embodiments, but should be defined in accordance with the following claims appended hereto and their equivalents. For example, although the collar may be a separate structure from the rim of the can, it will be appreciated that the collar may be formed as a part of the can rim. Generally, according to the spout of the present disclosure, in its retracted position, the spout fits within the can and engages the rim either directly or through a separate collar so that the spout's top edge is proximate to the rim and sits below the lid of the can, whether the lid is friction fit to the original can rim or if it is fit to the top side of the collar and in the spout's extended position, its bottom flange sealingly engages with the bottom side of the rim, either directly or through the separate collar, and the spout's top edge is situated outside the opening of the can.

What is claimed is:

1. A pouring assembly for engaging with a rim of a container, comprising;

a spout receivable within the container, wherein the spout translates relative to the rim between a retracted position and an extended position, wherein the spout comprises a top edge and a bottom edge, an exterior sidewall, a bottom flange protruding a bottom flange width from the exterior sidewall proximate to the bottom edge, a lower body portion proximate to the bottom edge, an upper body portion proximate to the top edge, and a tab protruding a tab width from the exterior sidewall proximate to the top edge of the spout, wherein the tab engages a rim topside and the bottom flange is disengaged from a rim bottom side when the spout is in the retracted position, wherein the bottom flange sealingly engages the rim bottom side and the tab is disengaged from the rim topside when the spout is in the extended position, wherein the lower body portion and the upper body portion respectively comprise a body length, wherein the lower body portion contacts the rim as the spout translates between the retracted position and the extended position, wherein the upper body portion is spaced a radial distance from the rim in the retracted position, and wherein the body length of the upper body portion is less than the body length of the spout lower body portion.

2. The pouring assembly of claim 1 further comprising a collar, wherein the collar comprises an outer collar edge, an inner collar edge, and a ledge, wherein the ledge comprises a ledge topside and a ledge bottom side, wherein the ledge radially extends a ledge width from the inner collar edge past the rim, wherein the tab engages the ledge topside and the bottom flange is disengaged from the ledge bottom side when the spout is in the retracted position, and wherein the bottom flange sealingly engages the ledge bottom side and the tab is disengaged from the ledge topside when the spout is in the extended position.

3. The pouring assembly of claim 2, wherein the spout further comprises a guiderail and the collar further comprises a notch, wherein the guiderail protrudes from the exterior sidewall between the tab positioned at a top end of the guiderail and a bottom end proximate the bottom flange of the spout, and wherein the guiderail translates within the notch between the retracted position and the extended position.

4. The pouring spout of claim 3, wherein the guiderail further comprises at least one of a friction fit, a ball detent and a slide lock proximate to the bottom end opposite from the tab, wherein the guiderail engages the notch in the friction fit, wherein the ball detent engages the ledge topside in the extended position, wherein the slide lock rotates the spout about the ledge between an unlocked orientation and a locked orientation in the extended position.

5. The pouring assembly of claim 4, wherein the spout is further comprised of a plurality of tabs, an interior sidewall, and a pair of planar handles, wherein a pair of tabs are positioned on opposite sides of the tab at the top of the guiderail, where the plurality of tabs extend from the exterior sidewall of the spout proximate to the top edge and engage the ledge topside in the retracted position, and wherein the pair of planar handles extend from the interior sidewall of the spout proximate to the top edge and respectively comprise a gripping aperture.

6. The pouring assembly of claim 4, wherein the slide lock further comprises a space between the bottom flange and the bottom end of the guiderail of the spout, wherein the ledge further comprises a pair of lock stops positioned on opposite sides of the notch, wherein a first lock stop is proximate to the notch, wherein a second lock stop is offset from the notch, wherein the ledge translates within the space between the locked orientation and the unlocked orientation, wherein the guiderail abuts the first lock stop and engages the notch in the unlocked orientation, and wherein the guiderail rotates about the ledge towards the second lock stop and disengages from the notch in the locked orientation.

7. The pouring assembly of claim 2, wherein the collar is selected from the group consisting of a bottom mount collar and a top mount collar, wherein the bottom mount collar is connected to the rim bottom side, wherein the top mount collar is connected to the rim topside, and wherein the bottom mount collar and top mount collar are respectively connected to the rim by at least one of an integral connection, a permanent connection and a removable connection.

8. The pouring assembly of claim 1, wherein the lower body portion is along a first plane substantially parallel to a sidewall of the container, wherein the upper body portion angles away from the lower body portion to a second plane offset from the first plane at the top edge of the spout, and wherein the spout further comprises a spout friction fit between the lower body portion and the rim in the extended position.

9. The pouring assembly of claim 1, wherein the upper body portion, the lower body portion, and the rim respectively comprise an upper body diameter, a lower body diameter, and a rim diameter, wherein the upper body diameter is less than the lower body diameter, and wherein the lower body diameter is approximately equal to the rim diameter.

10. The pouring assembly of claim 1, wherein the tab is further comprised of at least one of a flat bottom tab, a hook, and a circumferential flange.

11. The pouring assembly of claim 1, wherein the spout is further comprised of at least one of a solid circumferential body, a threaded body, a telescoping body, an accordion body, a folding body, and a mixing body, and wherein the mixing body comprises a plurality of mixing apertures.

12. A pouring assembly for engaging with a rim of a container around a container opening, comprising;

a collar comprising an outer collar edge, an inner collar edge, and a ledge, wherein the ledge comprises a notch, a ledge topside and a ledge bottom side, wherein the outer collar edge is aligned with an outer rim edge, wherein the inner collar edge is aligned with an inner rim edge, and wherein the ledge radially extends a ledge width from the inner collar edge into the container opening past the inner rim edge; and a spout receivable within the collar, wherein the spout translates relative to the collar between a retracted position and an extended position, wherein the spout comprises a top edge, a bottom edge, an exterior sidewall, a bottom flange protruding a bottom flange width from the exterior sidewall proximate to the bottom edge, a tab protruding a tab width from the exterior sidewall proximate to the top edge of the spout, and a guiderail, wherein the tab engages the ledge topside and the bottom flange is disengaged from the ledge bottom side when the spout is in the retracted position, wherein the bottom flange sealingly engages the ledge bottom side and the tab is disengaged from the ledge topside when the spout is in the extended position, wherein the guiderail protrudes from the exterior sidewall between the tab positioned at a top end of the guiderail and a bottom end proximate the bottom flange of the spout, and wherein the guiderail translates within the notch between the retracted position and the extended position.

13. The pouring assembly of claim 12, wherein the collar further comprises a collar protuberance, a collar channel, a collar topside, and a collar bottom side, wherein the rim further comprises a rim channel between the outer rim edge and the inner rim edge, wherein the collar protuberance protrudes from the collar bottom side, wherein the collar channel is recessed from the collar topside, wherein the collar protuberance and the collar channel are positioned between the outer collar edge and the inner collar edge, wherein the collar protuberance is seated within the rim channel, and wherein the collar channel is positioned above the protuberance and the rim channel.

14. The pouring assembly of claim 12, wherein the collar further comprises a collar protuberance, wherein the rim further comprises a rim channel and a rim bottom side, wherein the rim channel is spaced a distance from an outer rim edge, wherein the outer rim edge is connected to an interior sidewall of the container, and wherein the collar protuberance is proximate to the outer rim edge and sandwiched between the interior sidewall of the container, the rim bottom side and the rim channel.

15. The pouring spout of claim 12, wherein the guiderail further comprises a slide lock proximate to the bottom end opposite from the tab, wherein the slide lock further comprises a space between the bottom flange and the bottom end of the guiderail of the spout, wherein the ledge further comprises a pair of lock stops positioned on opposite sides of the notch, wherein a first lock stop is proximate to the notch, wherein a second lock stop is offset from the notch, wherein the slide lock rotates the spout between an unlocked orientation and a locked orientation in the extended position, wherein the ledge translates within the space between the locked orientation and the unlocked orientation, wherein the guiderail abuts the first notch and engages the notch in the unlocked orientation, and wherein the guiderail rotates towards the second lock stop and disengages the notch in the locked orientation.

16. A pouring assembly for connecting to a paint can between a can rim and a can lid, comprising:

a collar mounted within a rim channel in the rim of the can surrounding a can opening, wherein the collar comprises an outer collar edge, an inner collar edge, a ledge, a collar protuberance, a collar channel, a collar topside, and a collar bottom side, wherein the collar protuberance protrudes from the collar bottom side, wherein the collar channel is recessed from the collar topside, wherein the collar protuberance and the collar channel are positioned between the outer collar edge and the inner collar edge, wherein the collar protuberance is seated within the rim channel, wherein the collar channel is positioned above the collar protuberance, wherein the ledge comprises a ledge topside and a ledge bottom side, wherein the ledge radially extends a ledge width from the inner collar edge into the can opening past an inner rim edge, and wherein a lid protuberance removably connects to the collar channel; and a spout receivable within the collar, wherein the spout translates relative to the collar between a retracted position and an extended position, wherein the spout comprises a top edge, a bottom edge, an exterior sidewall, a bottom flange protruding a bottom flange width from the exterior sidewall proximate to the bottom edge, and a tab protruding a tab width from the exterior sidewall proximate to the top edge of the spout, wherein the tab engages the ledge topside and the bottom flange is disengaged from the ledge bottom side when the spout is in the retracted position, and wherein the bottom flange sealingly engages the ledge bottom side and the tab is disengaged from the ledge topside when the spout is in the extended position.

17. The pouring assembly of claim 16, wherein the spout further comprises a lower body portion proximate to the bottom edge and an upper body portion proximate to the top edge, wherein the lower body portion is along a first plane substantially parallel to a sidewall of the container, and wherein the upper body portion angles away from the lower body portion to a second plane offset from the first plane at the top edge of the spout.

18. The pouring assembly of claim 16, wherein the spout further comprises a guiderail and the collar further comprises a notch, wherein the guiderail protrudes from the exterior sidewall between the tab positioned at a top end of the guiderail and a bottom end proximate the bottom flange of the spout, and wherein the guiderail translates within the notch between the retracted position and the extended position.

19. The pouring spout of claim 18, wherein guiderail further comprises at least one of a friction fit, a ball detent and a slide lock proximate to the bottom end opposite from the tab, wherein the guiderail engages the notch in the friction fit, wherein the ball detent engages the ledge topside in the extended position, wherein the slide lock rotates the spout about the ledge between an unlocked orientation and a locked orientation when in the extended position, wherein the guiderail engages the notch in the unlocked orientation, and wherein the guiderail disengages the notch in the locked orientation.

20. The pouring assembly of claim 12, wherein the spout further comprises a lower body portion proximate to the bottom edge and an upper body portion proximate to the top edge, wherein the lower body portion and the upper body portion respectively comprise a body length, wherein the lower body portion contacts the ledge as the spout translates between the retracted position and the extended position, wherein the spout upper body portion is spaced a radial distance from the ledge in the retracted position, and wherein the length of the upper body portion is less than the length of the lower body portion.

* * * * *